US006250963B1

(12) United States Patent
Wright

(10) Patent No.: US 6,250,963 B1
(45) Date of Patent: Jun. 26, 2001

(54) CONNECTOR SHELL, CONNECTOR ASSEMBLY AND METHOD OF FABRICATING SAME

(75) Inventor: John O. Wright, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/385,147

(22) Filed: Aug. 30, 1999

(51) Int. Cl.[7] ..... H01R 13/40
(52) U.S. Cl. ..... 439/589; 439/903
(58) Field of Search ..... 439/578, 583, 439/584, 589, 901, 903, 607, 675

(56) References Cited

U.S. PATENT DOCUMENTS 3,793,610 * 2/1974 Brishka ..... 439/349
4,046,451 * 9/1977 Juds et al. ..... 439/583
4,614,398 * 9/1986 Wright et al. ..... 439/579
5,466,173 * 11/1995 Down ..... 439/584
5,632,651 * 5/1997 Szegda ..... 439/578
5,695,357 * 12/1997 Wright ..... 439/394
5,746,619 * 5/1998 Harting et al. ..... 439/352
5,879,191 * 3/1999 Burris ..... 439/584
6,042,422 * 3/2000 Youtsey ..... 439/585

* cited by examiner

*Primary Examiner*—Khiem Nguyen
*Assistant Examiner*—Son V. Nguyen
(74) *Attorney, Agent, or Firm*—William H. McNeill

(57) ABSTRACT

A connector assembly, and method of fabricating such connector assembly, is provided. The connector assembly includes a cable/insulator/contact sub-assembly which extends into a connector shell and is attached thereto in such a manner as to seal the interface between the connector shell and the cable where the cable is inserted therein, and to mechanically attach the connector shell to the insulator. A connector shell useful in such connector assembly.

20 Claims, 4 Drawing Sheets

CONNECTOR SHELL, CONNECTOR ASSEMBLY AND METHOD OF FABRICATING SAME

TECHNICAL FIELD

The present invention relates to a connector assembly, and method of fabricating a connector assembly, which includes a connector shell sealed to a conductor such as a coaxial cable and mechanically attached to a connector insulator. The connector assembly of the present invention is particularly useful with an antenna cable in an automotive environment. A connector shell for use with the connector assembly of the present invention is also provided.

BACKGROUND ART

It is known to provide an audio antenna connector attached to a coaxial cable. In fabricating such a connector, the central conductor of the cable, which serves as the signal wire, is soldered to a female contact or male contact of the connector. For example, typically a coaxial cable is provided having an end that has been stripped in a known manner such that a length of the central conductor and central conductor insulator extend from the end of the cable. The usual shield layer is folded back upon the cable jacket. The central conductor insulator is disposed within a plastic insulator that is disposed within an outer metal connector shell. The electrical connection is completed by soldering the central conductor to a contact. The folded back shield layer engages an inner surface of the connector shell to provide the necessary grounding. Although other configurations may be provided, in each configuration sealing is not provided at the interface between the cable and the connector shell. In some applications, water intrusion by capillary action has been a problem.

SUMMARY OF THE INVENTION

It is an object of the present invention to provide an improved connector assembly.

Another object of the present invention is to provide an improved connector assembly that obviates the disadvantages of the prior art.

A further object of the present invention is to provide an improved connector assembly that includes a seal at the interface where a conductor is inserted into a connector shell.

Yet another object of the present invention is to provide an improved connector assembly which is useful with an antenna cable and which accomplishes the foregoing objectives.

Another object of the present invention is to provide a method of fabricating the connector assembly of the present invention.

Yet a further object of the present invention is to provide an improved connector shell which may form a part of the connector assembly of the present invention.

This invention achieves these and other objects by providing a connector assembly that comprises a conductor such as, for example, a coaxial cable having a contact electrically and mechanically connected thereto. In the case of a coaxial cable, the contact is connected to the central conductor of the cable at one end thereof. An insulator is also provided comprising a bore extending therethrough in a first direction of a longitudinal axis. The insulator includes a peripheral groove extending in an outer surface thereof. A seal extends peripherally about the cable. A connector shell is provided which comprises a cavity. The seal and at least the length of the insulator that comprises the insulator groove are disposed within the cavity, the seal being pressed between the connector shell and the cable. A segment of the connector shell extends into the groove, and a shield layer of the cable is electrically connected to the connector shell.

BRIEF DESCRIPTION OF THE DRAWINGS

This invention may be clearly understood by reference to the attached drawings in which like reference numerals designate like parts and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

The connector assembly of the present invention comprises a conductor having a contact electrically and mechanically connected to one end thereof in any conventional manner, as for example by soldering or welding. An insulator is provided having a bore extending therethrough and a peripheral groove extending in an outer surface of the insulator. The conductor and/or the contact extend in the bore of the insulator. A seal is attached to the conductor in such a manner that it extends peripherally about the conductor. A connector shell having a central cavity is provided. The insulator and the conductor are disposed within the shell cavity at least to the extent that the seal and the groove are disposed within the cavity. The seal is sandwiched between the connector shell and the conductor, and a segment of the connector shell extends into the groove.

Figure 1:
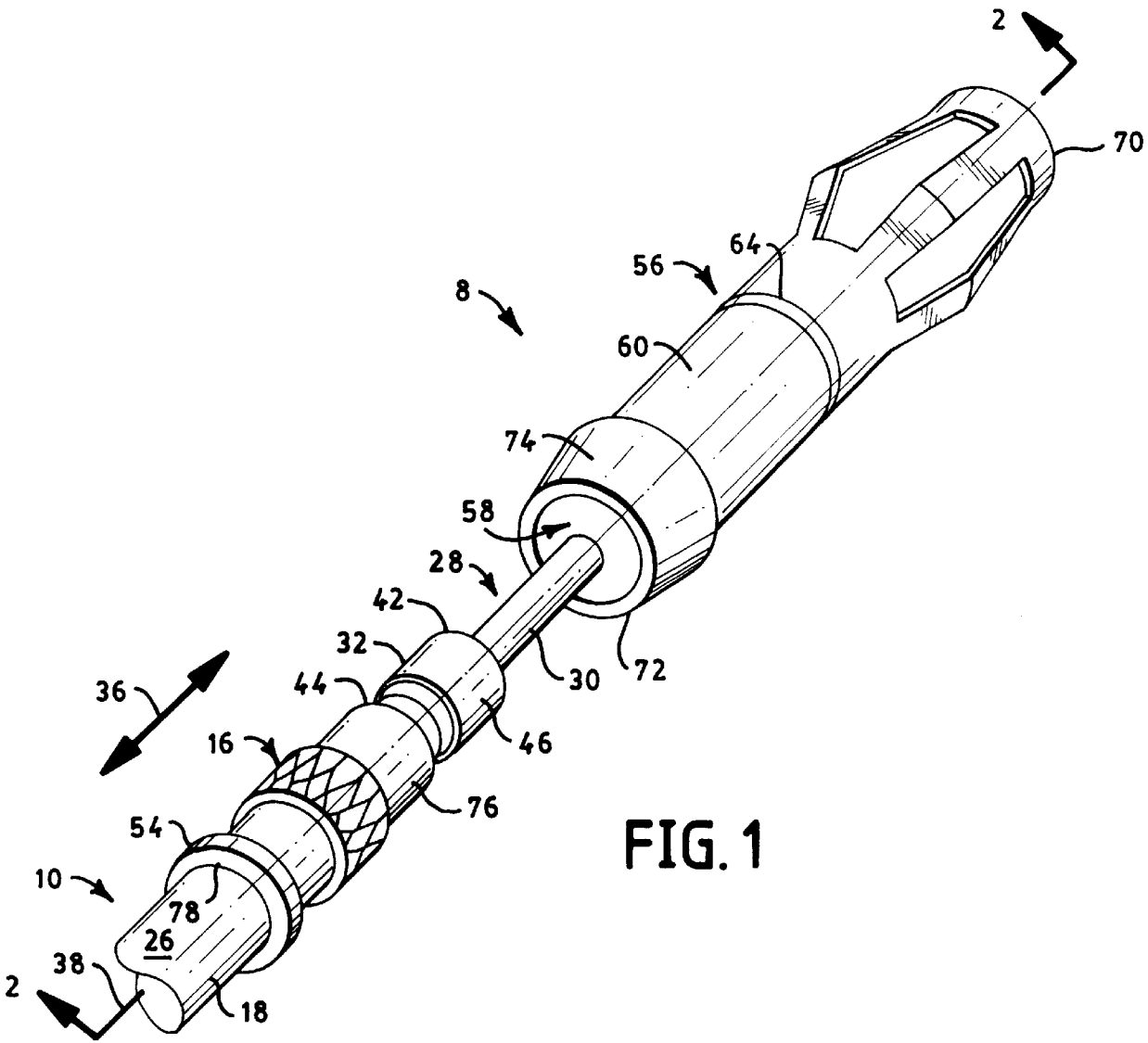
FIG. 1 is an exploded view of one embodiment of a connector assembly of the present invention.
Figure 2:
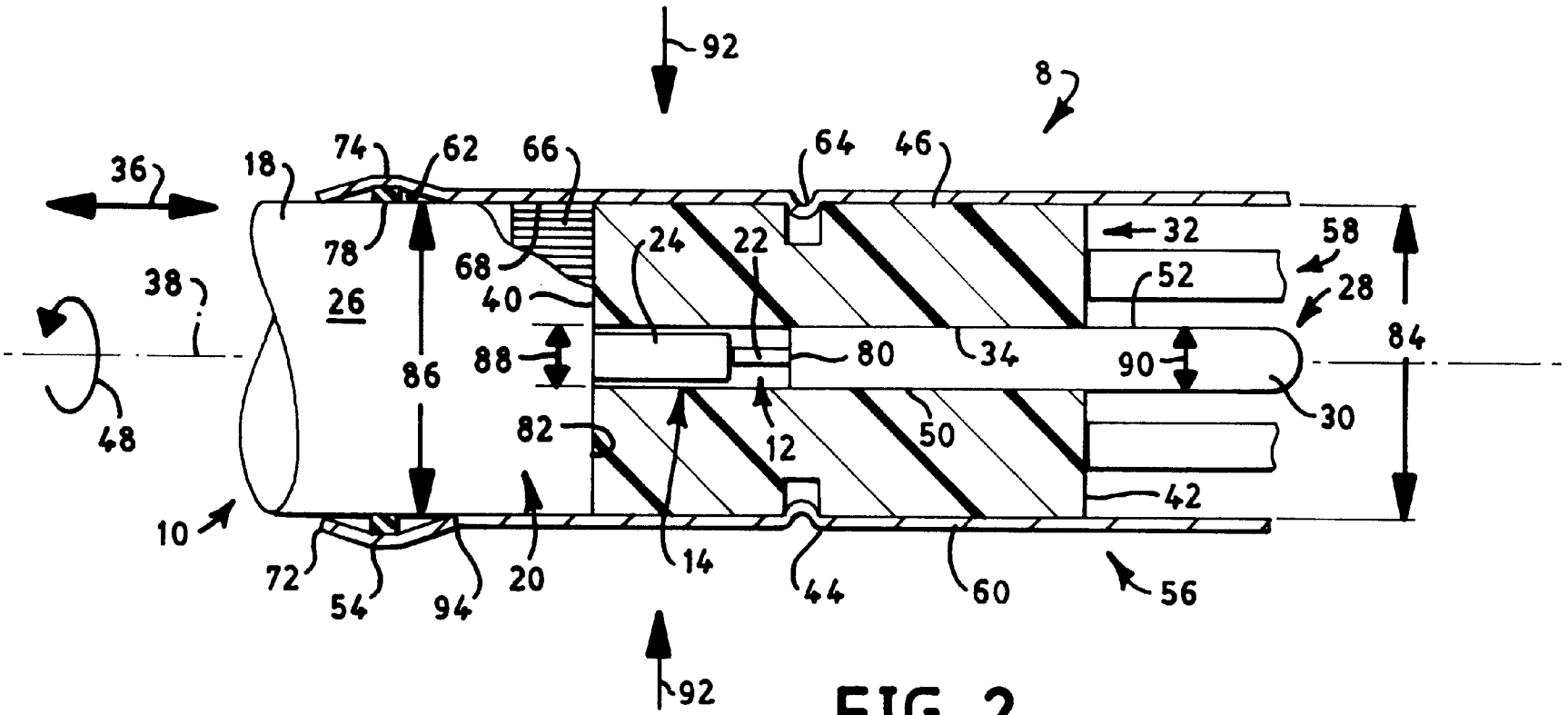
FIG. 2 is a sectional view of the connector assembly of FIG. 1 taken along lines 2—2.

Referring to the drawing, FIGS. 1 and 2 illustrate one embodiment of a connector assembly 8 of the present invention wherein the conductor is a typical coaxial cable 10 comprising a central conductor 12, an insulative layer 14, a shield layer 16 and an outer covering or jacket 18. The end 20 of the cable 10 has been prepared in a conventional manner such that a length 22 of the central conductor 12 and a length 24 of the insulative layer 14 extend at such end of the cable. The shield layer 16 is folded back upon an outer surface 26 of the jacket 18.

A contact 28 is electrically and mechanically connected to the central conductor 12 at end 20 in any conventional manner, such as by soldering or welding. In FIGS. 1 and 2, the contact 28 is illustrated as a male prong 30 which is provided for mating with a conventional female contact typically in the form of a ferrule, which may be electrically and mechanically connected to a circuit, such as a printed circuit, or another conductor, in a conventional manner. Alternatively, contact 28 could be in the form of a female contact provided for mating with a male contact.

An insulator 32 having a bore 34 extending therethrough is provided. The insulator 32 and bore 34 extend in the direction 36 of a longitudinal axis 38 from an end 40 to an opposite end 42. A peripheral groove 44 extends in an outer surface 46 of the insulator. Without limitation, in the embodiment illustrated in FIGS. 1 and 2, the insulator 32 is cylindrical in configuration, and the groove 44 extends in a circumferential direction 48 relative to axis 38. The insulator 32 is disposed adjacent the end 20 of the cable 10. A length 50 of the male prong 30, and the lengths 22 and 24 of the central conductor 12 and insulative layer 14, extend into the bore 34 of the insulator 32. A length 52 of the prong 30 extends from the bore 34 and is structured and arranged in a conventional manner for mating with a female ferrule-like contact. The male prong 30 may be force fit into bore 34 to hold the prong firmly in place relative to the insulator 32.

A seal 54 is attached to the cable 10 such that the seal extends peripherally about the outer surface 26 of jacket 18. In the embodiment illustrated in FIGS. 1 and 2, seal 54 extends in direction 48. Without limitation, the seal may be die cut or molded from an elastomeric material to provide a quadrilateral cross section illustrated as a square in FIG. 1. Alternatively, seal 54 may be a conventional O-ring or any other seal configuration and material that may be assembled in the connector assembly of the present invention as described herein.

A conductive connector shell 56 having a cavity 58 is provided. The connector shell comprises a tubular shell body 60 that forms the cavity 58. In the embodiment illustrated in FIGS. 1 and 2, the portion of the end 20 of the cable 10, which includes the seal 54, and the insulator 32 including the groove 44, is disposed within the cavity 58 of the shell body. The seal 54 is pressed between an inner surface 62 of the shell body 60 and the outer surface 26 of the jacket 18 to provide a seal between the shell body and the cable 10. A segment 64 of the shell body 60 extends into the groove 44 to firmly attach the shell body to the insulator 32. In the embodiment illustrated in FIGS. 1 and 2, the folded back length 66 of the shield layer 16 is sandwiched between the jacket 26 and an inner surface 68 of the shell body 60 and is thereby electrically connected to the shell body.

In the embodiment illustrated in FIGS. 1 and 2, the shell body 60 extends from an end 70 to an opposite end 72. End 70 is structured and arranged for connection to a mating connector in a conventional manner. End 72 is structured and arranged to engage the seal 54 at inner surface 62 and thereby effect the sealing between the cable 10 and the shell body 60. To this end, the end 72 comprises a bead 74 that may be crimped toward axis 38 during fabrication of the connector assembly 10 to compress the seal 54 against the jacket 26. In the embodiment illustrated in FIGS. 1 and 2, the bead 74 extends in direction 48. The segment 64 located between ends 70 and 72 of the connector shell 60 may be extended into groove 44 during a conventional pressing operation whereby the connector shell may be deformed at segment 64 into the groove. In the embodiment illustrated in FIGS. 1 and 2, the segment 64 extends peripherally about the connector shell 60 in direction 48.

In order to facilitate insertion of the contact 28 into the bore 34 of the insulator 32, the insulator may comprise a slit 76 which extends axially in direction 36 from end 40 to end 42, and radially towards axis 38 from the outer surface 46 of the insulator to the bore 34. The slit 76 provides some resilience to the insulator 32 as the contact 28 is inserted into the bore 34.

Various processing steps may be used in the fabrication of the connector assembly of the present invention. It will be readily apparent to those having ordinary skill in the art that the order of such steps may be readily varied. In one embodiment of the method of the present invention useful in fabricating the connector assembly of FIGS. 1 and 2, the end 20 of the cable 10 may be prepared in a conventional manner to provide the length 24 of the insulative layer 14 and the length 22 of the central conductor 12. The length 66 of shield layer 16 may be folded back upon the jacket 26. The seal 54 may be attached to the cable 10 at the end 20. In particular, the cable 10 may be inserted through the opening 78 in the annular-like seal 54 until the seal is positioned as required for positioning it within the cavity 58. The contact 28 may be electrically and mechanically connected to the central conductor 12 by, for example, soldering the two together at 80. The insulator 32 may be coupled adjacent to the cable 10 by inserting the prong 30 of the contact 28 through the bore 34 until the end 40 of the insulator abuts the portion 80 of the cable 10 which has not been prepared as described above.

Figure 3:
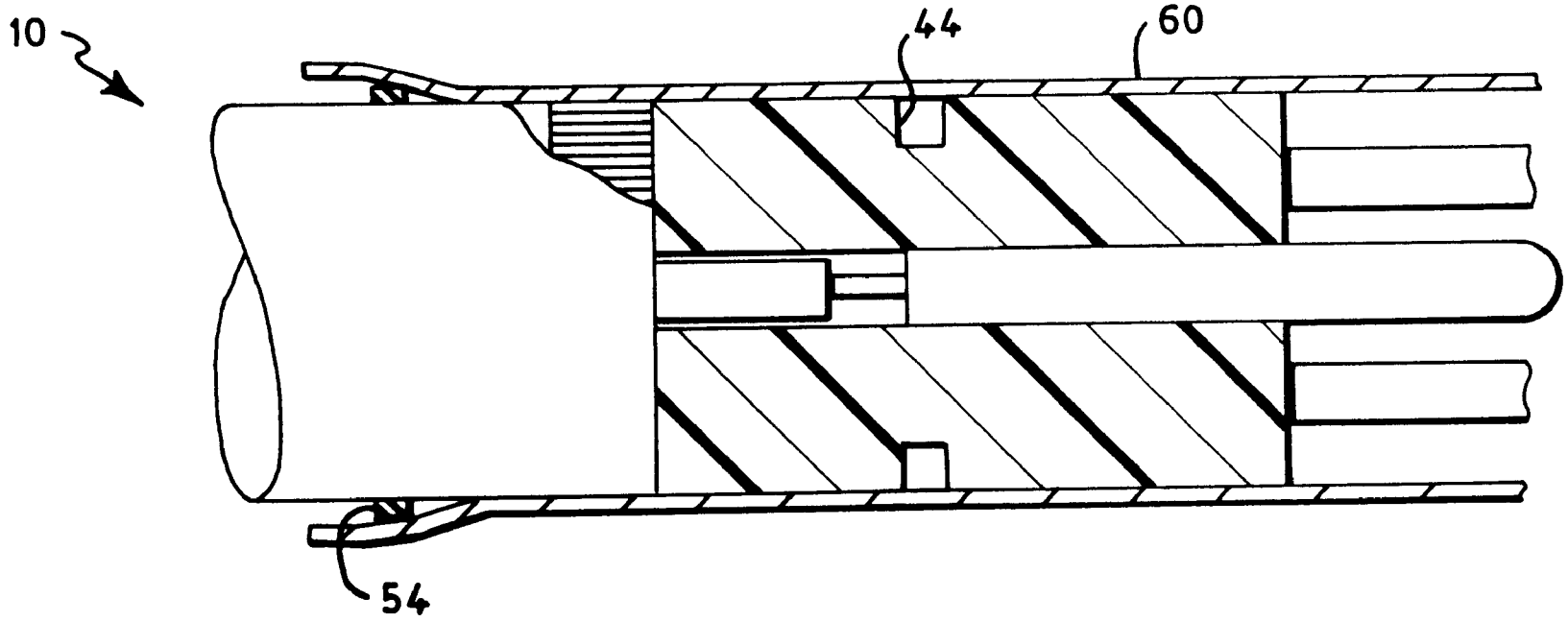
FIG. 3 is a diagrammatic illustration of a cable disposed within an end of a connector shell of the present invention prior to further processing.
Figure 4:
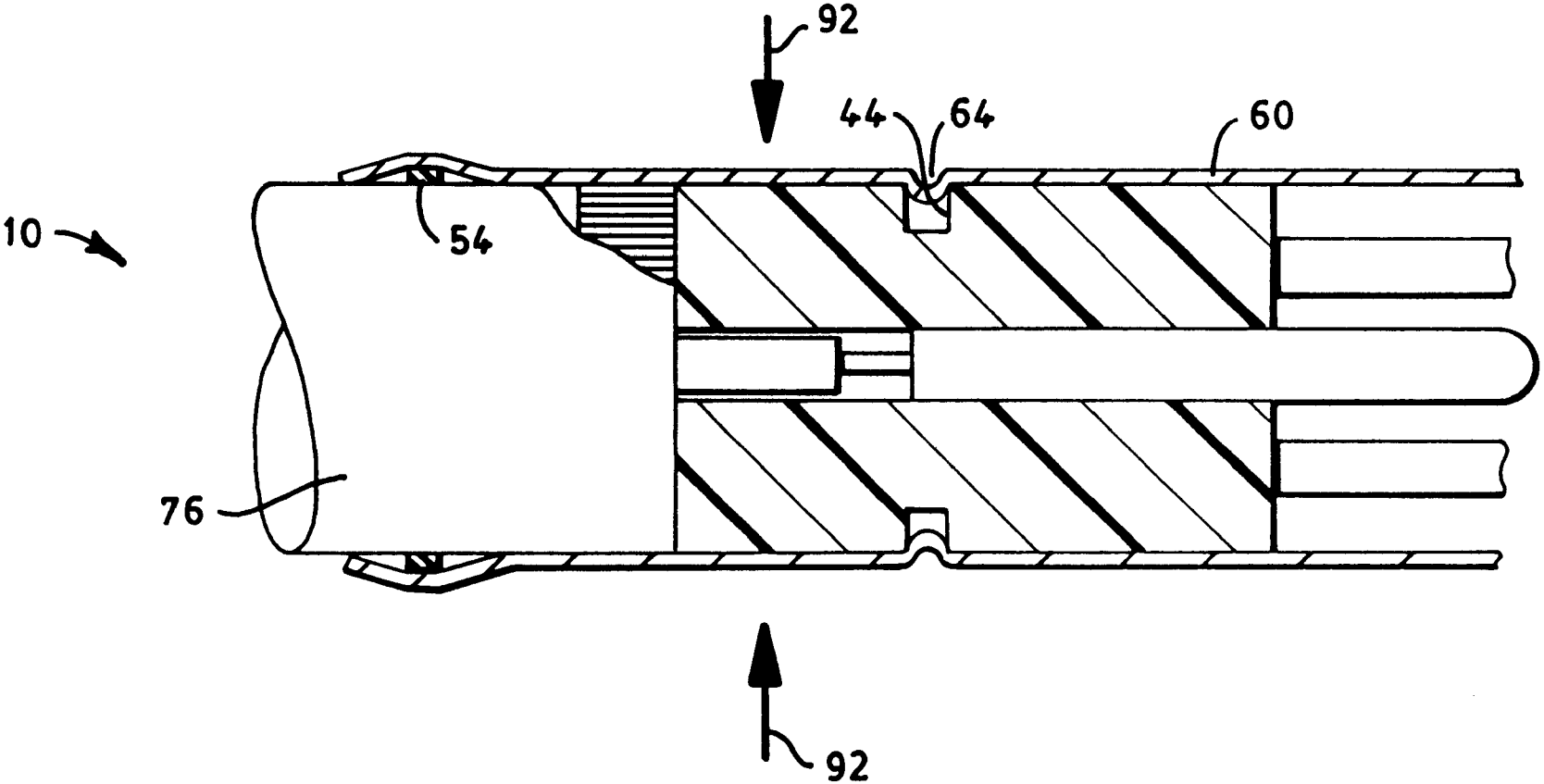
FIG. 4 is a diagrammatic illustration similar to FIG. 3 but at the completion of the processing of the connector assembly of the present invention.

The connector shell 60 may be formed with the bead 74 at end 72 in a conventional manner. The cable 10/contact 28/insulator 32 sub-assembly may be inserted into the cavity 58 of the connector shell 60 at least to the extent that the groove 44 and the seal 54 are positioned within the cavity. By dimensioning the internal diameter 84 of the connector shell 60 to be about equal to or slightly less than the diameter 86 of the cable 10, the insertion of the cable into the cavity 58 in this manner will provide a force fit between the cable and the connector shell and electrically connect the length 66 of shield layer 16 to the connector shell as a result of the contact between the shield layer and the inner surface 68. By dimensioning the internal diameter 88 of the bore 34 to be about equal to or slightly less than the diameter 88 of the prong 30, the insertion of the prong into the bore 34 will provide a force fit between the prong and the insulator 32. The connector shell body 60 may be pressed in direction 92 radially inwards toward axis 38 throughout its circumference to cause the segment 64 to be extended into groove 44 to affix the cable 10/contact 28/insulator 32 sub-assembly to the connector shell. The connector shell 60 may also be pressed in direction 92 radially inwards toward axis 38 throughout its circumference to crimp the shell into engagement with the seal 54 to thereby seal the interface 94 between cable 10 and the connector shell body 60. Seal 54 may be an elastomeric seal in which case the elastomeric seal will be compressed between the inner surface 62 and the jacket surface 26 during such pressing application. FIGS. 3 and 4 diagrammatically illustrate these features. In particular, FIG. 3 illustrates the cable 10, groove 44 and seal 54 positioned within the connector shell body 60 prior to the pressing operation. FIG. 4 illustrates the compressed elastomeric seal 54, and the segment 64 extended into groove 44, subsequent to the pressing of the shell body 60 in direction 92 to crimp the bead 74 into engagement with the jacket surface 76 and to depress the segment 64 into the groove.

The embodiments which have been described herein are but some of several which utilize this invention and are set forth here by way of illustration but not of limitation. It is apparent that many other embodiments that will be readily apparent to those skilled in the art may be made without departing materially from the spirit and scope of this invention.

What is claimed is:

1. A connector assembly, comprising:

a coaxial cable;

a contact electrically and mechanically connected to a central conductor of said cable at one end of said cable;

an insulator coupled to said cable and comprising a bore extending therethrough in a first direction of a longitudinal axis, a peripheral groove extending in an outer surface of said insulator;

a seal extending peripherally about said cable; and a connector shell comprising a connector shell body forming a cavity, said seal and said groove being disposed within said cavity, said seal being disposed between said connector shell body and said cable to effect sealing between said connector shell body and said cable, and a segment of said connector shell body extending into said groove whereby said connector shell body and said insulator are affixed together, a shield layer of said cable being electrically connected to said connector shell body.

2. The connector assembly of claim 1 wherein said groove and said seal each extend in a circumferential second direction relative to said axis.

3. The connector assembly of claim 2 wherein said connector shell body comprises a bead at one end of said connector shell, said bead extending in said second direction and pressing said seal against said cable.

4. The connector assembly of claim 3 wherein said segment extends peripherally about said connector shell body in said second direction.

5. The connector assembly of claim 3 wherein said shield layer is folded back upon an outer surface of said cable and is sandwiched between said outer surface and said bead.

6. The connector assembly of claim 5 wherein said segment extends peripherally about said connector shell body in said second direction.

7. The connector assembly of claim 6 wherein said insulator is split axially from an outer surface of said insulator to said bore.

8. The connector assembly of claim 1 wherein said insulator is split axially from an outer surface of said insulator to said bore.

9. The connector assembly of claim 1 wherein said shield layer is folded back upon an outer surface of said cable and is sandwiched between said outer surface and said connector shell body.

10. A method of fabricating a connector assembly, comprising the steps of:

attaching a seal peripherally about a cable;

connecting a contact electrically and mechanically to said cable;

coupling an insulator having a bore extending therethrough, and a peripheral groove extending in an outer surface thereof, to said cable;

inserting at least a length of said cable and said insulator, which comprise said seal and said groove, respectively, into a connector shell body;

pressing said connector shell body against said seal sufficiently to effect sealing between said cable and said connector shell body; and pressing a segment of said conductor shell body into said groove.

11. The method of claim 10 further comprising the step of providing said connector shell body with a bead at one end thereof, and wherein said first pressing step comprises pressing said bead thereby pressing said seal between said bead and said cable.

12. The method of claim 11 further comprising the step of force fitting a length of said contact into said bore.

13. The method of claim 12 wherein said coupling step comprises providing an insulator which is split axially from an outer insulator surface to said bore to facilitate said force fitting step.

14. The method of claim 10 wherein said cable is a coaxial cable and further including the steps of folding a length of a shield layer of said cable back upon a length of an outer surface of said cable, and electrically connecting said connector shell body to said shield layer.

15. A connector assembly, comprising:

a conductor;

a contact electrically and mechanically connected to said conductor at one end thereof;

an insulator coupled to said cable and comprising a bore extending therethrough in a first direction of a longitudinal axis, a peripheral groove extending in an outer surface of said insulator;

a seal extending peripherally about said conductor; and a connector shell body comprising a cavity, said seal and said groove being disposed within said cavity, said seal being disposed between said connector shell body and said conductor to seal an interface between said connector shell body and said conductor, and a segment of said connector shell body extending into said groove whereby said connector shell body and said insulator are affixed together.

16. The connector assembly of claim 15 wherein said groove and said seal each extend in a circumferential second direction relative to said axis.

17. The connector assembly of claim 16 wherein said connector shell body comprises a bead at one end thereof, said bead extending in said second direction and pressing said seal against said conductor.

18. The connector assembly of claim 17 wherein said insulator is split axially from an outer surface of said insulator to said bore.

19. A connector shell for attachment to one end of a conductor having a seal extending peripherally thereabout and a contact mechanically and electrically connected thereto, an insulator having a peripheral groove extending in a segment of an outer surface thereof coupled to said one end, comprising a shell body surrounding a cavity and extending from a first end to an opposite second end, said shell body being structured and arranged to contain said seal and said groove in said cavity, said first end being structured and arranged for connection to a mating connector, said second end being structured and arranged to engage said seal and effect sealing between said conductor and said shell body, and a length of said shell body between said first end and said second end being extendable into said groove whereby said connector shell body and said insulator are affixed together.

20. The connector shell of claim 19 wherein said second end comprises a bead thereabout.

* * * * *